United States Patent [19]

Boot

[11] 4,432,171

[45] Feb. 21, 1984

[54] BUILDING MODULES

[75] Inventor: Phillip H. Boot, N. Turramurra, NS, Australia

[73] Assignee: Hanford Pty, Ltd., New South Wales, Australia

[21] Appl. No.: 417,340

[22] Filed: Sep. 13, 1982

Related U.S. Application Data

[63] Continuation of Ser. No. 158,230, Jun. 10, 1980, abandoned.

[30] Foreign Application Priority Data

Jun. 14, 1979 [AU] Australia ..... PD9214

[51] Int. Cl.[3] ..... E04H 1/00; E04B 1/348

[52] U.S. Cl. ..... 52/79.1; 52/745

[58] Field of Search ..... 52/79.1, 741, 745, 79.7, 52/79.9, 79.11, 79.14, 80; 264/31-35

[56] References Cited

U.S. PATENT DOCUMENTS

| | | | |
|---|---|---|---|
| 3,110,907 | 11/1963 | King | 52/79.1 X |
| 3,479,786 | 11/1969 | Kreier | 52/745 |
| 3,961,002 | 6/1976 | Brown | 52/791 X |
| 4,011,705 | 3/1977 | Vanderklaauw | 52/745 |
| 4,077,170 | 3/1978 | van der Lely | 52/79.1 |
| 4,138,833 | 2/1979 | Townend | 52/745 |

FOREIGN PATENT DOCUMENTS

| | | | |
|---|---|---|---|
| 6709528 | 1/1968 | Netherlands | 52/79.1 |
| 985338 | 3/1965 | United Kingdom . | |
| 1346059 | 2/1974 | United Kingdom . | |

*Primary Examiner*—J. Karl Bell

*Attorney, Agent, or Firm*—Murray & Whisenhunt

[57] ABSTRACT

A room sized building module made up of a three dimensional skeletal frame comprising wall frames and a ceiling frame constructed as a unitary integral structure adapted to be attached or moulded to a floor, the whole frame being constructed in a reinforced concrete matrix material, the frame being formed around and bonded to a premade sheet of lining material strong enough to be self supporting between the frame members, the lining material and the frame combining together structurally to provide a rigid transportable module. The ceiling of the module is preferably domed.

8 Claims, 6 Drawing Figures

BUILDING MODULES

This is a Continuation application of Ser. No. 158,230, filed June 10, 1980 now abandoned.

The present invention relates to improvements in or relating to building construction and more particularly to the production of room sized modules from which both single and multi storey buildings may be constructed.

The concept of this type of industrialised or manufactured housing is adequately explained in Australian Pat. No. 464,495 "Improvements in or relating to Building Construction".

The object of the invention is to provide further improvements in manufactured housing.

It has been found that in general terms manufactured or precast concrete housing has become less acceptable to the more sophisticated markets of the western world as their standard of living improves. Environmental and sociological impacts of family living in very large multi storey housing estates have been a major cause of abandonment of this general concept.

As mentioned before, the standards of living in western countries have risen by a large degree in the last two decades. The effect of this has been to create a more discerning market attitude on behalf of the home or dwelling purchaser. Individuality and personal taste have become important marketing factors to which constructors have had to adjust.

Technology also has developed so as to reduce the impact of higher wages on conventional methods of construction.

Projects, particularly apartment buildings, have generally become smaller in number with much more accent on a lesser number of storeys and smaller blocks, having better amenities and being generally closer to the individual dwelling concept.

The overall effect of this market transition has been to offset seriously and adversely the large mass produced prefabricated concrete housing industry as projects become smaller and more individualistic in style. The number of changes required during production has multiplied to such an extent as to make the operation uneconomical, particularly where it requires a large amount of capital to be invested in a manufacturing operation.

Conventional construction adapted to the changing tastes much more easily and competed more favourably on the major sections of the market. The number of companies operating and the percentage of the market that prefabricated concrete housing established shrank annually and in some markets totally disappeared.

Concepts of room sized modules such as described in Australian Pat. No. 464,495, whilst coping more effectively with changing architectural styles and tastes, only represented a very low percentage of the cost of the finished dwelling. The effect of this was that capital investment in factory and plant to produce these modules became too high to complete openly to any large degree with conventional construction.

It became evident that the room sized module concept was still valid in that the type of module, its costs, flexibility of planning was still superior to large precast panel construction.

A major segment of the market is the single family dwelling and as is well understood such dewellings are erected on separate plots or lots of land of differing dimensions. Any factory built housing therefore finds it very difficult to cope with these changes in dimensions and still remain viable.

Further, projects during their planning stages undergo continuous changes and redesigns and are only usually finalised weeks before construction is due to start. The smaller the project, the more prone it is to undergo these types of changes. It is also well understood that mass production lines cannot adjust readily or economically to too many variations or alterations to the proposed product.

Whilst room size modules enjoy an advantage of design flexibility against large multi-room modules, mould changes cannot be economical or feasible if the production level is low or late planning changes occur.

Of great importance economically in any manufacturing operation is the factory size in relation to its production level. Being three dimensional and room sized creates a much larger demand for factory space as well as module movement problems within the factory. The time gap between module manufacture and fitting out and transportation becomes a very important factor as any delay at that stage creates a storage and a logistic problem which has an unfavourable impact on the economics of the system, e.g., after curing, concrete requires a time in which to dry out prior to fitting out and painting. In some atmospheres this could be up to one week, therefore occupying large factory floor spaces. If modules dry out too quickly, they suffer from cracking due to drying shrinkage. It became evident that certain factors of prefabricated concrete housing needed more development. The critical requirements are:

1. A very light module for ease of transport and erection.
2. Minimum of capital expenditure on factory and equipment.
3. Minimum of in-factory module movement.
4. Minimal delay between casting or moulding operations and transport.
5. Maximum number of module sizes with minimum number of moulds.
6. Ability to manufacture efficiently a small construction on site or next to it, i.e., without factory cover if desirable.
7. Minimum time required between project planning and production of modules, e.g., no more than six weeks.
8. The interior surface should be as close to conventional as possible.
9. Minimal production cycle time. As the real advantage of a building system is appreciated in on site time savings, this saving can be easily eroded if the modules have to be manufactured and fitted out too long a period beforehand. Ideally they should be completed in the factory just prior to erection on site.
10. To have minimal drying shrinkage cracking that necessitates repairs after the dwelling is occupied. Drying shrinkage is an inherent problem with concrete structures, particularly three dimensional modules.
11. Internal surface finish of the module should not necessitate the use of special paints or applications of any material so as to cover poor moulding facilities or to hide shrinkage cracking.

Not only must a module conform to the above criteria, but it must also fulfill its original basic requirement other than being cost competitive, and that is to act as a capsule for the finishes that are contained inside. It must be strong enough to be transported and erected without distress or damage that would necessitate anything other than cosmetic repairs.

The basic aims of the invention may be summarised as follows:

1. To produce a module with a minimal amount of concrete material, labor and equipment required during peak periods, i.e., during the manufacture of modules.
2. To reduce the amount of time between module manufacture and transportation so as to minimise factory size.
3. To reduce the amount of capital funds in factory and equipment necessary to produce small production levels.
4. To shorten the usual lead time necessary for all concrete precast building systems between finalisation of dwelling design including last minute alterations and commencement of production.
5. To reduce further than other previous inventions the weight of the modules resulting in very basic lifting and crane facilities. The economical level of three dimensional modules is considered to be below 5,000 kg.
6. To prevent any shrinkage cracking of the concrete being apparent on the internal side of the box module.
7. To maximise the performance by rationalising the section qualities of the wall and ceiling elements of the module, e.g., the walls act as deep beams supplying vertical stiffness to the module. However, in order to achieve adequate stiffness there is no need that the beam be solid. Instead, more efficiency is gained by constructing the beam as a type of open truss and increasing its thickness to prevent bluckling. This saves material, but necessitates the sheeting or closing in of the wall element. A similar criteria of dead weight reduction is applied to the roof element.
8. To utilise existing codes of minimal concrete cover to reinforcement whilst using an approved lining material to span the spaces between ribs.

The invention consists in a room sized building module made up of a three dimensional skeletal frame comprising wall frames and a ceiling frame constructed as a unitary integral structure adapted to be attached or moulded to a floor, the whole frame being constructed in a reinforced concrete matrix material, the frame being formed around and bonded to a premade sheet of lining material strong enough to be self supporting between the frame members, the lining material and the frame combining together structurally to provide a rigid transportable module. A minor or major portion of one or more of the wall frames may be omitted to provide for door or window openings or for the juxtaposition of two modules to form a large room.

The invention also consists in a method of making a module as defined in the last preceding paragraph.

In order that the nature of the invention may be better understood, details of a building module constructed according to the invention and different methods of constructing it are described, by way of example, with reference to the accompanying drawings in which:

FIG. 6 is partially sectioned isometric view of a building module during formation of the same.

Figure 1:
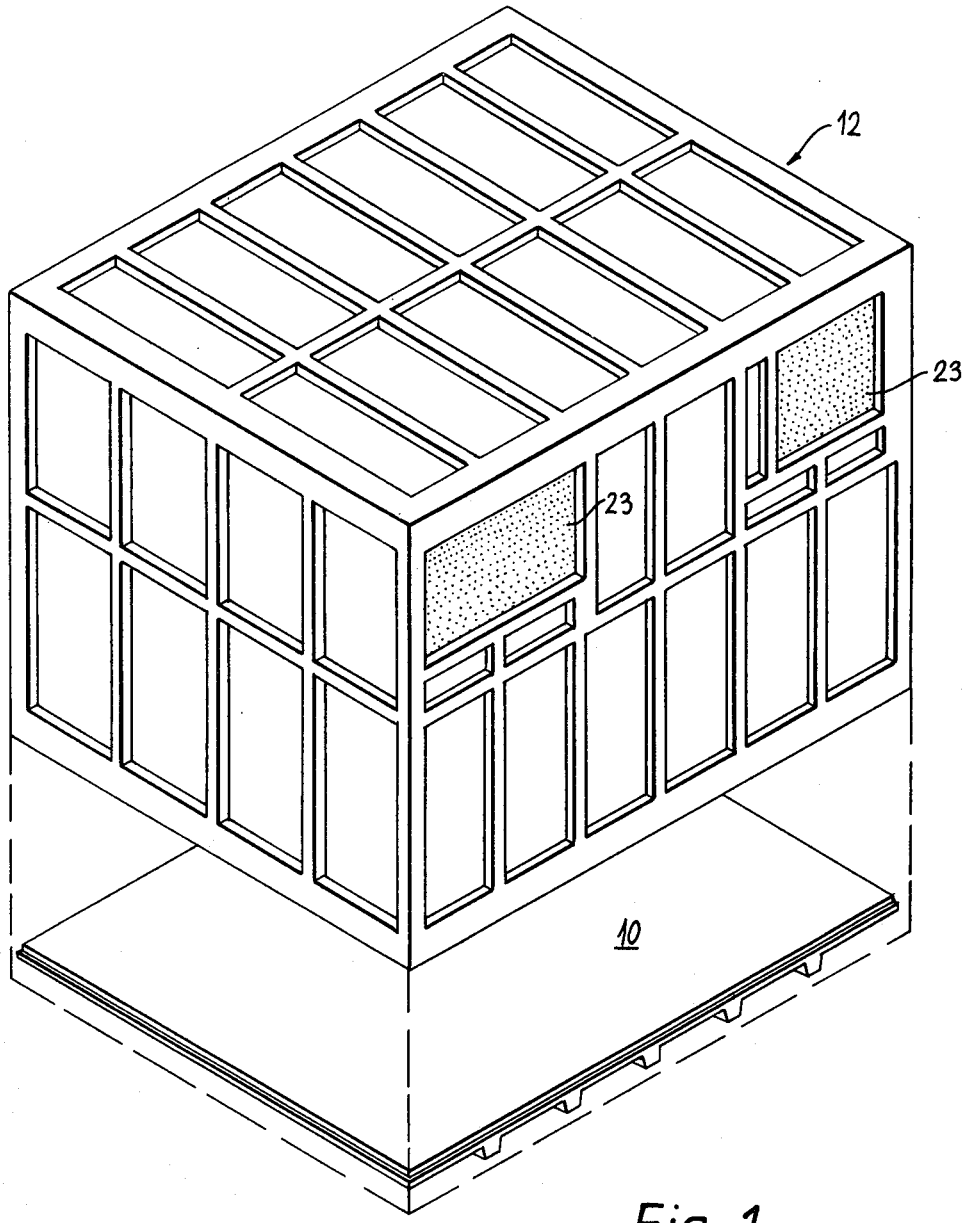
FIG. 1 is an isometric view of a building module.

The module is constructed to be attached to a reinforced concrete floor 10 constructed along conventional lines with ribs 11. Reinforcing rods (not shown) are included in the ribs and preferably these are turned upwardly so as to enable members of the skeletal frame 12 to be cast around them. The floor is nominally 25 mm thick, strengthened by 100 mm parallel ribs spaced at approximately 450 mm centres.

The reinforced concrete skeletal frame 12 consists of 60 mm×50 mm vertical ribs 13 spaced at 450 mm centres that approximately coincidewith the floor ribs 11.

Three tranverse or horizontal beams 14, 15 and 16 intersect the vertical ribs 13 at:

(a) beam 14 at the base of the frame, the size of the beam being 50 mm×200 mm, (b) beam 15 at the junction of the walls and ceiling of the module, the beam size being 50 mm×200 mm, and (c) beam 16 arranged approximately half way up the wall height, the beam size being 50 mm×50 mm.

At the corners of the walls of the module an L-shaped section 17 of 85 mm×50 mm is formed to create stiffness at that joint.

The ceiling consists of transverse ribs 18 of 50 mm×50 mm dimension running the width of the module. A rib 19 runs the length of the module intersecting the ribs 18 at their mid points.

Figure 2:
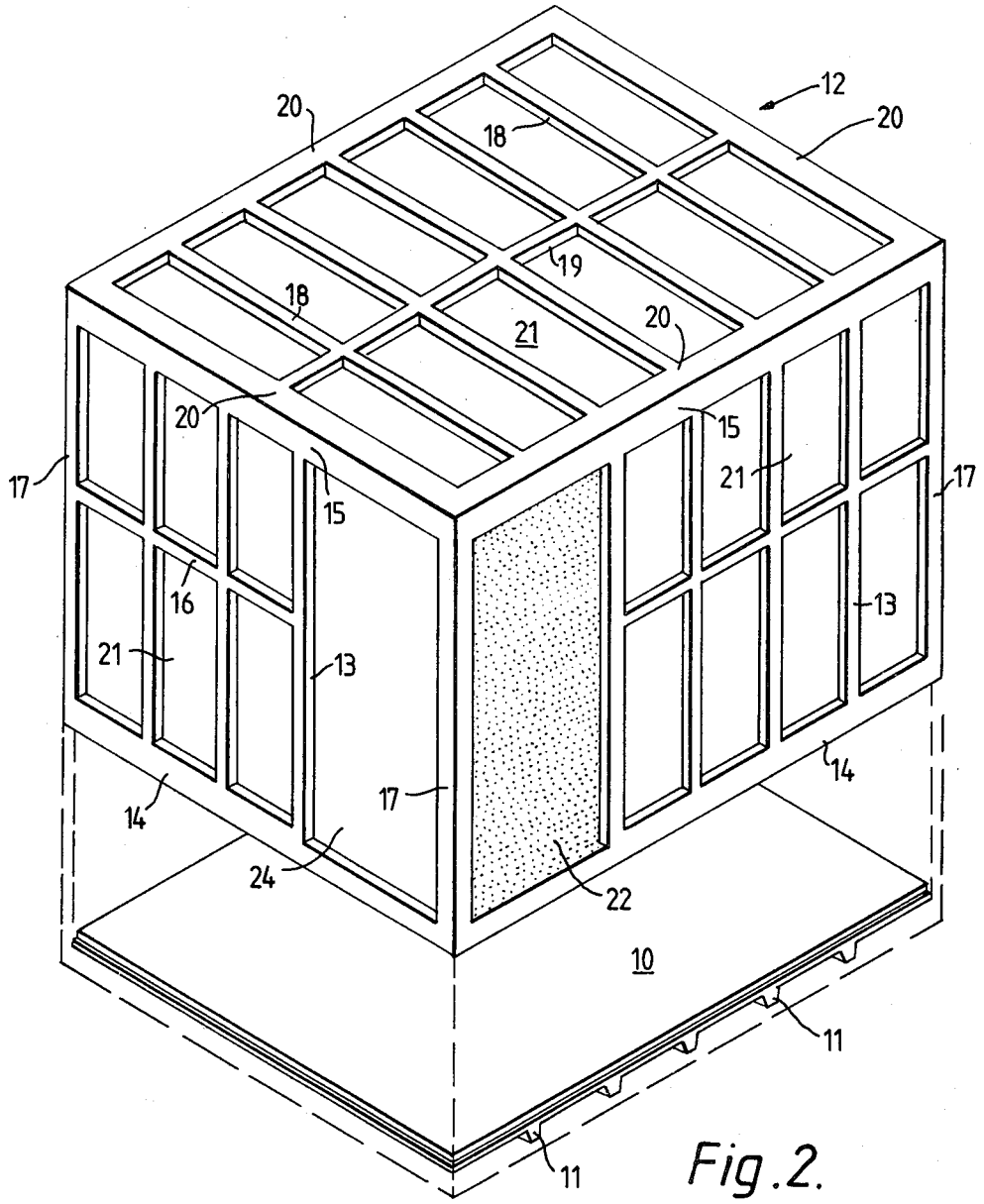
FIG. 2 is a similar view of the module seen from the opposite corner.
Figure 3:
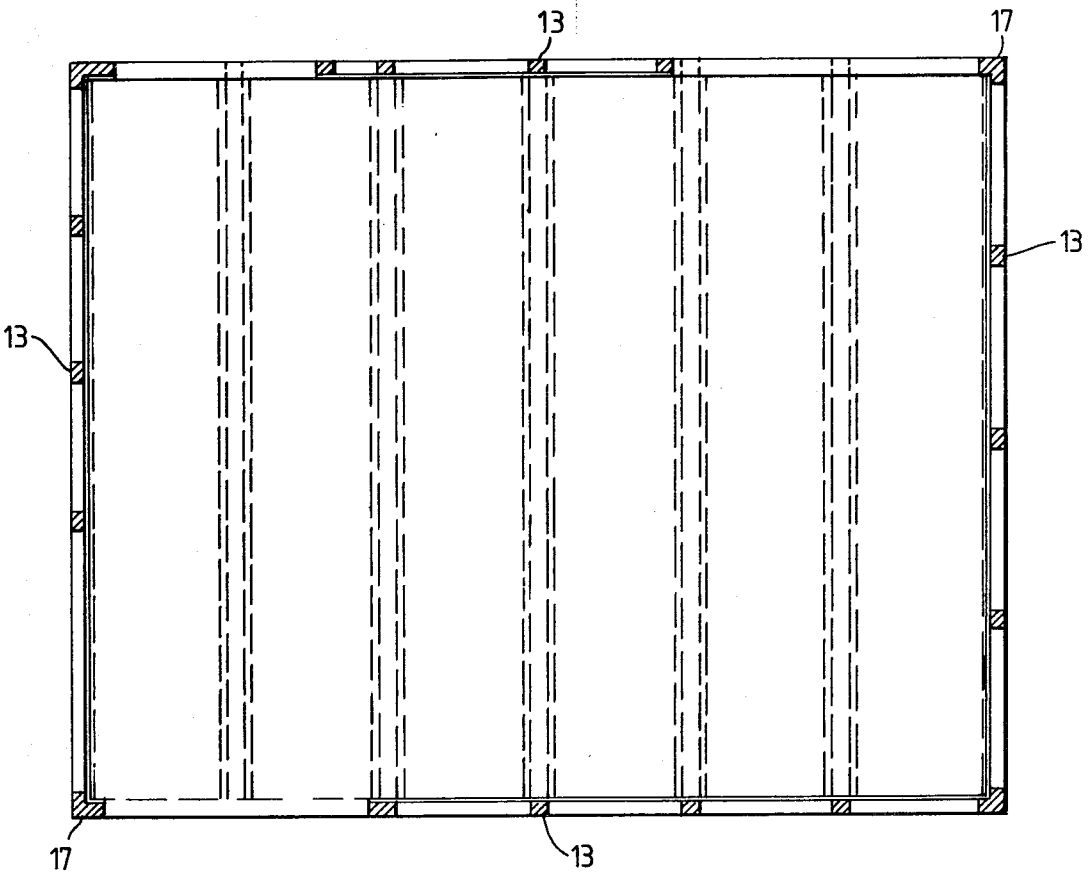
FIG. 3 is a plan view of the module.
Figure 4:
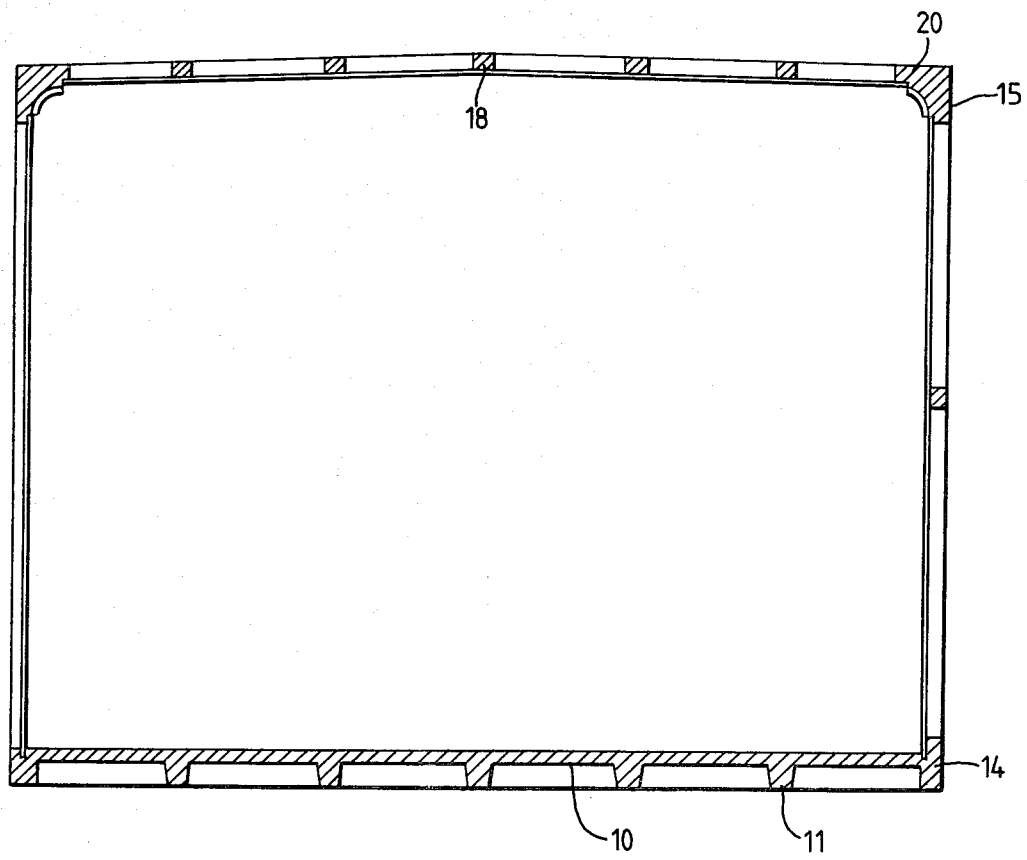
FIG. 4 is a longitudinal sectional view.
Figure 5:
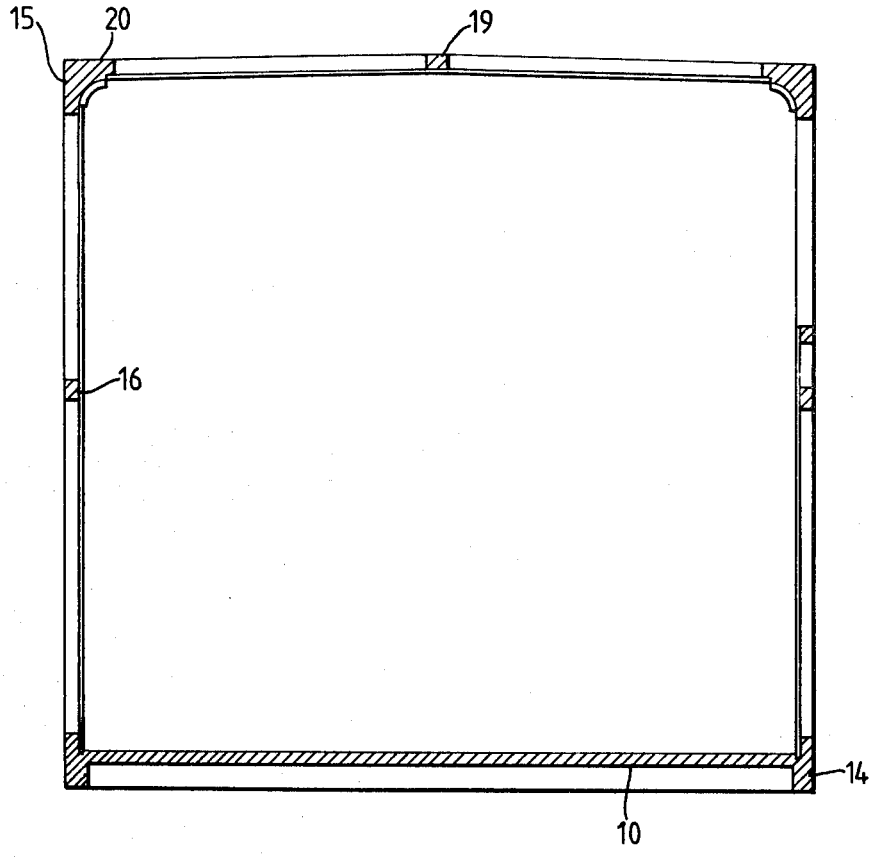
FIG. 5 is a transverse sectional view.

There is also a perimeter beam 20 which in conjunction with the wall ribs 15 forms an L-section thus stiffening the module at its uppermost perimeter. An optional 25 mm thick plate (not shown) can be cast over the ceiling ribs. The ribs of both the walls and the ceiling are lined with plaster board or asbestos reinforced board 21. This is cut away at the door opening 22 and the window openings 23. As may be seen from FIG. 2 provision is made for an additional or alternative door opening at 24. This is made functional simply by cutting away the lining material.

The module is constructed by erecting formwork 27 and temporarily fastening premade sheet lining material 25 to the formwork 27. Reinforcing steel 26 is erected around said lining material, appropriate to a three dimensional skeletal frame 12. Concrete matrix material is applied to said reinforcing steel 26 and to said lining material 25 to form a skeletal frame consisting of vertical ribs 13, which are intersected by three transverse or horizontal beams 14, 15 and 16; at the corners of the walls of the module an L-shaped section 17 is formed to create stiffness at the joint; a perimeter beam 20 in conjunction with beam 15 forms an L-shaped section stiffening the module at its uppermost perimeter; ceiling transverse ribs 18 run the width of the module and intersect at their midpoints with rib 19 running the length of the module; and the entire skeletal frame 12 is constructed of reinforced concrete matrix material which is bound to said premade lining material 25.

The concrete used in making the module is a conventional mixture of sand, cement aggregate and water with such conventional additives as are appropriate.

While no reinforcement metal is actually shown in the drawings, suitable reinforcement bars are included in all members of the skeletal frame.

A module measuring 3000×2500 mm externally and 2375 mm high was constructed in the following sequence:

1. The floor was cast horizontally on a flat concrete surface, a conventional concrete mix being used.
2. An internal timber framework was erected in conformity with the interior dimensions of a room.
3. A lining material was temporarily fixed to the outer face of the timber framework constituting the walls and ceiling.
4. The skeletal ribs were set out on the outer surfaces of the lining material having regard to the position of door and window openings and styrene slabs 50 mm thick were glued to the outer surfaces of the lining material, spaces being left between the slabs in areas in which ribs were to be formed, the spaces constituting in effect moulds for the concrete ribs.
5. Edge boards were erected to support the concrete for upper and bottom perimeter horizontal beams.
6. Reinforcement was fixed into the spaces left between the styrene slabs.
7. Concrete was sprayed into the abovementioned spaces and placed on the roof inside the upper edgeboards thus forming the skeletal frame, and allowed to cure.
8. Door and window openings were cut out of the lining board material.
9. The internal timber framework was dismantled and removed through the door opening.
10. The interior was then fitted out and painted.

As can be seen in this case, the skeletal frame was applied and bonded to the lining material which was in turn supported by the internal timber support frame. However, the skeletal ribs could easily be formed and poured instead of sprayed, the framework also being the support frame for the lining material. In this method the concreting procedure would be easier and faster, although the capital expenditure in moulds would be higher. This, however, need not represent a large factor, as pointed out earlier, if the moulding equipment was suitably extendable and adjustable to take into account infinite module dimension changes, thus enabling quick changes. The capital investment in the moulds could easily be justified.

As with both methods of manufacture, the floor, if there is to be a floor, is cast integrally with the skeletal frame. Therefore, there is only one bottom perimeter beam needed to enable the module to span from corner to corner on its foundations. Also, the steel reinforcement in the floor ribs is left extended so that the reinforcement in the wall rib can be lapped with it, thereby making it continuous and much stronger.

The module floor and the module itself are not necessarily moved prior to transportation to site. This eliminates the need for overhead travelling cranes, since a small mobile can load the module for transportation.

If a mould is used to form the skeletal ribs, this would be stripped from the concrete and carried to the next floor, wall by wall. Therefore, each wall mould would have to be light enough to be carried and positioned by two men.

The problem of carrying the fresh concrete to the module which could be some distance is not large, as the quantities used are very small and easily handled. Batching and mixing equipment is much smaller. The module can be fitted out and painted immediately after adequate curing is complete, as the lining board has been kept sufficiently dry for painting.

If drying shrinkage does occur, the subsequent cracking does not necessarily appear on the inside of the module surface, as the lining board masks the effect. Normal paints can also be used.

If it is found necessary to waterproof the module, then a coating of waterproofing agent can readily be sprayed on the wall and ceilings externally.

In the construction described above the ceiling ribs were cambered there being a rise at the centre of the ceiling of 50 mm. (This is not perceptible in the figures), thus giving rise to a shallow domed structure, for the following reasons:

(a) So that water could drain off the top of the module quickly (b) To improve their performance in spanning, this however is an advantage that is not a necessary part of this invention as the ribs have only to be formed deeper to span further or more effectively.

It may also be desired to place a solid 25 mm thick topping over the top of the ceiling ribs, e.g., if used in multi storey construction a module could be produced without a floor, but with a 25 mm topping on its ceiling, in which case the use of a domed ceiling is to be preferred. When placed on site, it would be positioned on an in-situ concrete floor, then the next upper floor can be poured directly on top of the module, i.e., the module would act as left-in-place or sacrificial formwork. If suitable mechanical ties and adhesions were placed on the 25 mm topping, then this thickness could be incorporated and form part of the overall floor thickness as required by concrete and fire rating codes. If this method were to be adopted "wet cores", i.e., bathrooms, kitchens, etc., would still have a floor which would sit in a recess in the in-situ floor and just a ribbed ceiling, the latter becoming the "false ceiling" needed to hide plumbing pipes, etc.

Vertical support columns would be poured in between modules as set out in other modular technical information. Using these techniques in multi storey buildings enables the horizontal reinforcement and the vertical reinforcement in the building structure to be continuous, thus totally conforming to structural codes. This factor has in many cases inhibited prefabricated concrete modules and panel multi-storey construction.

Another method of manufacture is firstly to cast the floor horizontally and after enough hardening has taken place, the same collapsible internal frame can then be erected, to which a lining material is attached.

Reinforcement in the form of 6 mm and 12 mm bars is then attached to the lining at the positions of the skeletal ribs and in the perimeter of wall beams. A bonding agent is then sprayed on to the lining board to the identical configuration of the reinforcement bar.

The rib is then simply sprayed on to the desired width and depth. The advantage of this method is to allow infinite random cross bracing or strengthening with very little preparation or any alteration to the internal support frame. The sprayed rib is then smoothed if desired or left in a rough textured surface.

Another additional advantage is the capability to produce a larger vertical structural member in the form of a column at the corners or mid points along the walls so as to facilitate the stacking of one module on top of another without any on site manufacture.

Alternatively, if it were more desirable to cast the vertical columns on site, a "concrete form" could be sprayed onto the module wall in the form of a "U" so that when a similar module was placed alongside with an identical "U" section formed vertically, the in-situ concrete could be poured from above down into the now formed box section. The rough surface left by the spray finish would facilitate perfect mechanical bonding causing a composite action between the outer concrete box form and the in-situ concrete inside it.

If required, a thin layer of concrete could be sprayed over all the exterior surface, thus making it stronger if this is desirable. However, structurally it is considered unnecessary.

Also, any waterproofing agent could be sprayed over the exterior of the module so as to increase its durability or resistance to damage during transportation and erection.

The lining material could be various types already used in construction of dwellings, e.g., (a) the various types of dry wall plasterboard,
(b) glass or fibre reinforced plaster sheet,
(c) reinforced cement based sheets.

The structural action of the various sheets of lining material will vary with their characteristics, e.g., the modules of elasticity. However, it is felt that they will play some part in stiffening and bracing the module box, especially if the skeletal ribs are very slender and small in section. It could, under certain circumstances, act as a stressed skin, thus stiffening the skeletal ribs in one direction at least.

Also, as the lining material used for the ceiling can be cambered or domed (although as previously stated this is not a necessity for its structural adequacy), there could be some beneficial structural membrane action from the cambered sheets, particularly as their perimeter is well anchored in the stiff upper concrete perimeter beam. Of course, in the above circumstances it would be vital that good bonding was achieved between the lining board and the skeletal rib.

It is important that the rib depth, i.e., that dimensions at right angles to the lining surface, be kept to a minimum, not only for the obvious reasons of material, cost, etc., but also to facilitate closer positioning of modules when placed alongside one another. For instance, a 100 mm deep rib would lead to an overall wall thickness of approximately 255 mm, as there would need to be at least 25 mm gap between modules.

The spacing apart of the ribs is also important and will vary with different types of lining material, e.g., its ability to span between ribs and still fulfil its function, although this situation would alter if a layer of concrete way sprayed or applied over the whole of the exterior walls and ceiling surfaces of the lining material, thus stiffening it.

The module that was produced and described in this specification also had an internal cornice approximately 4" (90 mm) wide at the junction of the wall lining sheet and the outer edge of the ceiling sheet (not shown in the drawings). This created a thickening of the concrete at that juncture, thus stiffening the knee and increasing the rigidity of the module as well as the relationship between wall rib and ceiling rib.

If more structural efficiency was required from the skeletal ribs, they could be increased in number in various ways:

(a) To slightly decrease the distance between ribs and also increase the number of horizontal ribs, thus forming a waffle grid of skeletal ribs in any one of the walls or all, as well as the ceiling. Such would be the case if one side of a module had to sustain wind loadings or other loadings whilst the other three sides did not. The side affected could be treated with a different grid system to overcome such problems.
(b) A much more efficient grid system, especially for the ceiling ribs, would be a skew grid system, i.e, running diagonally.

However, it is felt that the type tested and described in this specification is sufficient and most economical in most circumstances.

I claim:

1. A method of making a room sized building module having walls and a ceiling comprising the following steps:

(1) providing premade sheet lining material;
(2) erecting formwork to support said premade sheet lining material;
(3) temporarily fastening said lining material to the formwork to form the interior surface of the module;
(4) erecting reinforcing steel around said lining material appropriate to a three dimensional skeletal frame of reinforced concrete matrix material, said skeletal frame of reinforced concrete matrix material including a perimeter beam surrounding said ceiling and extending along the top of each wall, a vertical column at each wall corner, a beam extending along the bottom of each wall and connecting adjacent vertical columns, a plurality of spaced apart ceiling frame members in the ceiling forming a grid and extending between sides of the perimeter beam, and a plurality of spaced apart wall frame members forming a grid and extending between adjacent columns and between the perimeter beam and the beam along the bottom of the
(5) applying concrete matrix material to said reinforcing steel and to said lining material to form said skeletal frame around the reinforcing steel thereby bonding said concrete matrix material in the form of a skeletal frame to said lining material;
(6) cutting door and winddow openings in said lining material; and
(7) removing said formwork.

2. The method as claimed in claim 1 wherein said concrete matrix material is applied by spraying.

3. The method as claimed in claim 1 wherein said concrete matrix material is applied by casting.

4. The method as claimed in anyone of claims 1, 2 or 3 wherein a reinforced concrete floor is first formed and the module is made thereon.

5. A room sized building module having walls and a ceiling and comprising a premade sheet lining material and a three dimensional skeletal frame comprising wall frames and a ceiling frame, cooperating together to form a unitary integral structure adapted to be attached to a floor, said skeletal frame including a perimeter beam surrounding said ceiling and extending along the top of each wall, a vertical column at each wall corner, a beam extending along the bottom of each wall and connecting adjacent vertical columns, a plurality of spaced apart ceiling frame members in the ceiling forming a grid and extending between sides of the perimeter beam, and a plurality of spaced apart wall frame members forming a grid and extending between adjacent columns and between the perimeter beam and the beam along the bottom of the wall, said skeletal frame constructed of reinforced concrete matrix material, said skeletal frame being formed around and bonded to said premade sheet lining material, which is strong enough to be self-supporting between the frame members, said skeletal frame and said lining material structurally cooperating together to form a rigid transportable module.

6. The room sized building module as claimed in claim 5 wherein door and window openings are provided between the wall frame members.

7. The room sized building module as claimed in either of claims 5 or 6 wherein the sealing frame is domed.

8. The room sized building module as claimed in either of claims 5 or 6 having a floor of reinforced concrete matrix material attached thereto, reinforcement material in the floor extending into the members of the skeletal frame.

* * * * *